United States Patent [19]

Rice et al.

[11] Patent Number: 4,947,078

[45] Date of Patent: Aug. 7, 1990

[54] SEALED BEAM HEADLAMP

[75] Inventors: Lawrence M. Rice; Thomas E. Persing; Thomas J. Baldauf, all of Anderson, Ind.

[73] Assignee: General Motors Corporation, Detroit, Mich.

[21] Appl. No.: 361,082

[22] Filed: Jun. 5, 1989

[51] Int. Cl.[5] ..... H01J 5/54; H01K 1/46

[52] U.S. Cl. ..... 313/113; 313/25; 313/318; 362/285; 362/306; 445/3

[58] Field of Search ..... 313/25, 113, 318; 362/296, 306, 285; 439/611; 445/3

[56] References Cited

U.S. PATENT DOCUMENTS 4,310,772 1/1982 Tyler et al. ..... 313/318 X
4,622,486 11/1986 Endo ..... 313/318 X
4,623,958 11/1986 Van der Linde et al. ..... 313/318 X

*Primary Examiner*—Kenneth Wieder
*Attorney, Agent, or Firm*—Edward J. Biskup

[57] ABSTRACT

A sealed beam headlamp that includes a collar bonded to an annular flange formed on the rear of a reflector and having an opening with a cylindrical support surface for receiving a plug-type lamp bulb assembly formed with a spherical portion that allows the lamp bulb assembly to be moved as a unit axially and pivoted for adjusting the position of the filament of the lamp bulb assembly relative to the reflector of the headlamp.

5 Claims, 1 Drawing Sheet

SEALED BEAM HEADLAMP

Figure 1:
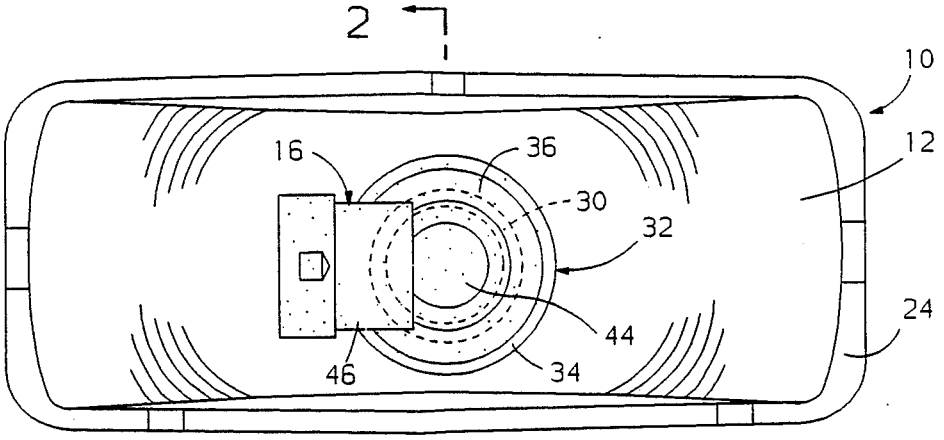

The present invention concerns headlamps and more particularly relates to a sealed beam lamp which permits ready and simple assembly and adjustments of the light source filament relative to the reflector focal point.

More specifically, the sealed beam headlamp according to the present invention comprises a reflector having a body portion, the rear end of which is formed with a circular opening for receiving a light bulb assembly that includes a plastic plug member formed with a spherical portion of a predetermined diameter and having a light bulb supported thereby. An annular flange is integrally formed with and projects axially outwardly from the rear end of the body portion of the reflector and concentrically surrounds the circular opening formed therein. A ring-like collar, which has an annular groove formed therein, receives the annular flange and is bonded thereto by a sealing cement located in the annular groove. A cylindrical support surface is located in the collar and has a diameter substantially equal to the predetermined diameter of the spherical portion of the light bulb assembly so as to allow the spherical portion to be located in the cylindrical support surface and be moved axially and pivoted for adjustment of the light bulb filament relative to the reflector. After the light bulb filament is adjusted in position relative to the reflector, a sealing cement is provided for bonding the light bulb assembly to the collar.

The objects of the present invention are to provide a new and improved sealed beam headlamp that includes a collar capable of being bonded to an annular flange formed in the rear of a reflector and having a cylindrical support surface for receiving a plug-type light bulb assembly formed with a spherical portion that allows the light bulb assembly to be moved as a unit axially and pivoted for adjusting the position of the lamp assembly relative to the reflector of the headlamp; to provide a new improved sealed beam headlamp in which a predetermined circular area around the opening for the light source is transparent and will allow ultraviolet light to pass through the circular area and cure an ultraviolet light cured adhesive used to bond a light bulb supporting adapter to the rear of the reflector; and to provide a new and inproved sealed beam headlamp in which the rear of the reflector is formed with an annular flange and cooperates with a collar that takes the form of a ring with an annular groove provided therein which, in the assembled position, mates with the flange and is bonded thereto by an ultraviolet light cured or other adhesive and that serves to support a plug-type light source having a spherical portion that allows the light source to be universally pivoted for adjusting the position of the filament within the light source relative to the reflector.

Three patents disclosing headlamps which have some similarity to the present invention are U.S. Pat. No. 1,369,722, in the name of B. Ames, issued on Feb. 22, 1921; U.S. Pat. No. 4,009,966, in the name of Gale M. Craig, issued on Mar. 1, 1977, and U.S. Pat. No. 4,310,722, in the name of Tyler et al, issued on Jan. 12, 1982.

Figure 2:
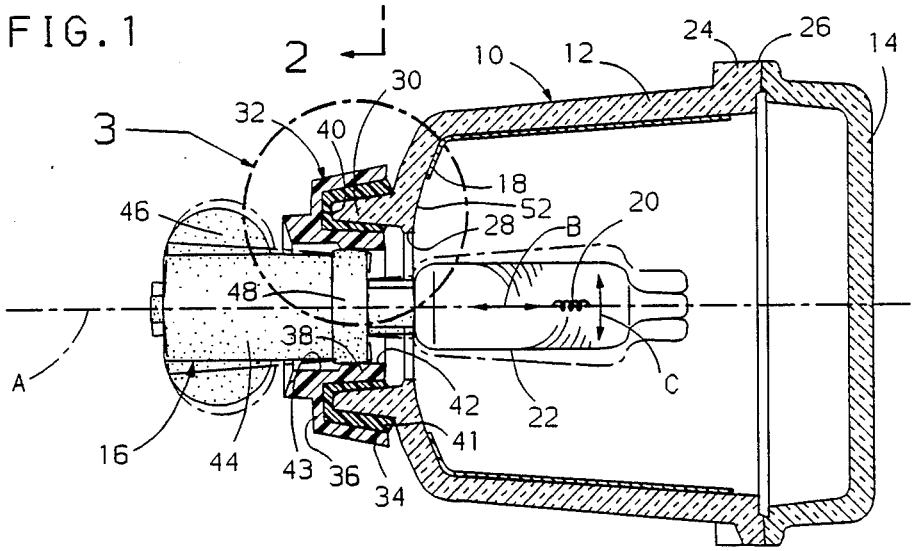
Figure 3:
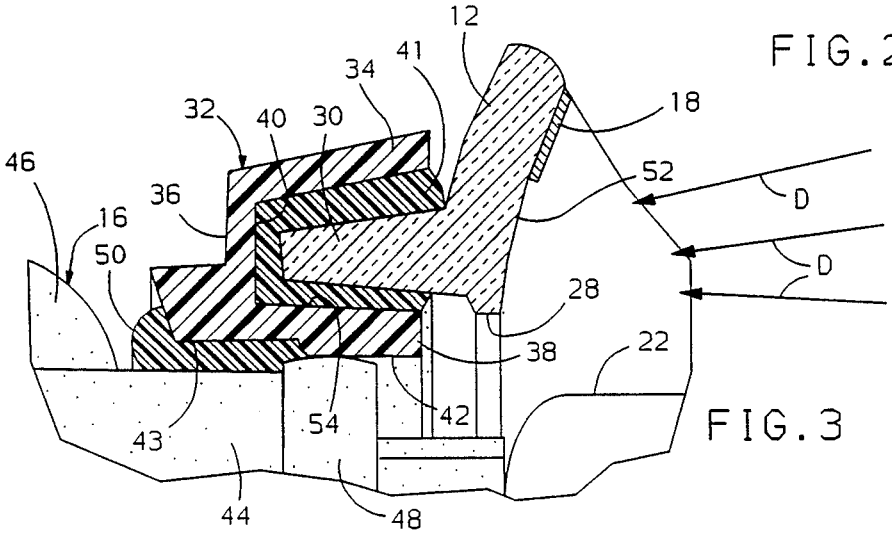

Other objects and advantages of the present invention will be apparent from a reading of the following detailed description when taken with the drawings in which FIG. 1 is a view of the rear end of a sealed beam headlamp according to the present invention;

FIG. 2 is a cross-sectional view of the sealed beam headlamp taken on line 2—2 of FIG. 1; and FIG. 3 is an enlarged view of the area enclosed in the circle seen in FIG. 2.

Referring now to the drawings and more particularly FIGS. 1 and 2 thereof, a rectangular sealed beam headlamp 10 is shown of the type used in motor vehicles. The headlamp 10 includes a reflector 12 and lens 14 and can be made of glass or plastic material as is well known in the headlamp forming art. A light bulb assembly 16, attached to the reflector in a manner to be described, also forms a part of the headlamp 10. The reflector 12 has a parabolic reflective surface or coating 18 of a reflective material, preferably a bright metallic deposit for directional control of light rays emitted by a helically coiled filament 20 located in the light bulb portion 22 of the light bulb assembly.

The lens 14 and the reflector 12 are joined at their peripheral edges to form a leakproof seal. As shown, radially outwardly extending rims 24 and 26 are formed on the peripheral portion of the reflector 12 and the lens 14, respectively, and a seal therebetween is obtained by any simple means such as ultrasonic welding, flame sealing or use of cement that is an epoxy or a polyester resin or a glass cement. The rear end of the reflector 12 has a circular opening 28 centrally formed therein and concentrically surrounding the opening 28 is an annular flange 30 of circumferentially uniform cross-section which projects axially outwardly from the main body of the reflector 12 and is integrally formed therewith. In this instance, the annular flange 30 is tapered when viewed in cross-section as seen in FIGS. 2 and 3 of the drawing.

The light bulb assembly 16 is joined to the reflector 12 through a socket member 32 that serves as an adapter and takes the form of a ring-like collar having a frustoconical outer configuration. The socket member 32 comprises an outer annular wall 34 joined by a vertical wall 36 to an inner annular wall 38. The outer annular wall 34, the vertical wall 36, and the inner annular wall 38 defined in annular groove or channel 40 to uniform cross-section which receives the annular flange 30 of the reflector 12 and is bonded thereto through an ultraviolet light activated adhesive or cement 41 such as Locktite 18041 available from Locktite Corporation, Newington, Conn. or some other type of adhesive or cement. The inner annular wall 38 of the socket member 32, in effect, is a cylinder which defines a cylindrical socket opening 42 which supports the light bulb assembly 16 and connects with a slightly larger cylindrical opening 43.

In this regard, it will be noted that the light bulb 22 of the light bulb assembly 16 is mounted to a plug member which consists of a cylindrical portion 44 integrally formed with a connector portion 46 that is at a right angle to the cylindrical portion 44. Suitable electrical conductors (not shown) are embedded in both the cylindrical portion 44 and connector portion 46 for electrical connection with the filament 20 of the light bulb 22 and with the electrical harness that connects to the connector portion 46 of the light bulb assembly 16 and provides electrical current for selectively energizing the light bulb filament 20. It will also be noted that the cylindrical portion 44 of the plug member has the end adjacent the light bulb 22 integrally formed with an enlarged spherical portion 48 which, at its maximum point when measured along an axis normal to the longitudinal center axis of the cylindrical portion 44, has a diameter substantially equal to the diameter at the socket opening 42. Thus, when the light bulb 22 of the light bulb assembly 16 is located in the socket opening 42, as seen in FIG. 2, the spherical portion 48 essentially closes the socket opening 42 and a snug fit is provided between the outer surface of the spherical portion 48 and the socket opening 42. After the filament 20 is adjusted in position relative to the reflector during the manufacturing operation, a small amount of UV activated adhesive will initially be placed in the annular space or chamber between the cylindrical portion 44 and the enlarged opening 43 of the socket member 32 to tack the light bulb assembly 16 in place. Afterwards, the aforesaid annular space can be filled with a heat type adhesive 50 such as Accuset 120/121 made by the aforementioned Locklite Corporation to permanently bond the light bulb assembly to the socket member 32. Also, during the manufacturing of the headlamp 10, the entire headlamp 10, as seen in FIG. 2, would be rotated 90° so that the lens 14 points downward and the longitudinal center axis A of the headlamp 10 is vertically orientated. Thereafter, an appropriate fixture will automatically grasp the plug portion of the light bulb assembly 16, energize the light bulb 22, and move the light bulb 22 axially in the direction of the arrow B and universally pivotally about the spherical portion 48 along one of an infinite number of curved paths transverse to axis A as indicated by the arrow C. The proper adjustment of the filament 20 relative to the reflector will be determined by optical sensor means when the predetermined optical optimum position producing the desired lighting pattern is achieved. The adjusted light bulb assembly 16 is then secured to the reflector by filling the aforementioned space as described above.

Prior to the bonding of the light bulb assembly 16 to the reflector 12 as described above, air within the headlamp envelope will be replaced by a dry gas so as to prevent from forming within the interior of the headlamp 10.

It will be noted that the adhesive for bonding the socket member 32 to the flange 30 can be activated by having the ultraviolet light directed through the lens in the manner shown in FIGS. *5d* and *5e* of U.S. Pat. No. 4,459,120 entitled, Sealed Beam Lamp and Method Of Manufacture, in the same name of Tyler et al, issued on July 10, 1984, and assigned to the assignee of the present invention. However, in this case in order for the UV light to pass through the reflector 12, a clear annular area 52 is provided surrounding the circular opening 28 in the reflector 12. In other words, as seen in FIG. 3, the annular area 52 is devoid of any coating of reflective material and therefore allows the UV light to pass through the reflector in the direction of the arrows D and activate the adhesive 41. It will also be noted that the inner annular wall 38 can be provided with ribs (not shown) which extend radially outwardly from the surface 54 and will abut the flange 30 for assuring that the socket opening 42 is concentric with the opening 28 when the socket member 32 is combined with the flange 30.

Various changes and modifications can be made in the construction of this seal beam headlamp without departing from the spirit of the invention. Such changes and modifications are contemplated by the inventors and they do not wish to be limited except by the scope of the appended claims.

The embodiments of the invention in which an exclusive property or privilege is claimed are defined as follows:

1. A sealed beam headlamp comprising a reflector having a body portion the rear end of which is formed with a circular opening for receiving a light bulb assembly and the front end of which is closed by a light controlling lens, said light bulb assembly including a plug member formed with a spherical portion of a predetermined diameter and having a light bulb supported thereby, an annular flange integrally formed with and projecting axially outwardly from said rear end of said body portion of said reflector and surrounding said circular opening, a ring-like socket member having an annular groove formed therein for receiving said annular flange, a sealing cement located in said groove for bonding said socket member to said flange, a cylindrical support surface located in said socket member and having a diameter substantially equal to said predetermined diameter of said spherical portion of said plug member so as to allow the latter to be located in said cylindrical support surface and be moved axially and pivoted about said spherical portion for adjustment of the bulb filament relative to the reflector, and a sealing cement bonding said plug means to said socket member after adjustment of said light bulb filament relative to said reflector.

2. A sealed beams headlamp comprising a reflector having a body portion the rear end of which is formed with a circular opening for receiving a light bulb assembly and the front end of which is closed by a light controlling lens, said light bulb assembly including a plug member formed with a spherical portion of a predetermined diameter and having a light bulb supported thereby, an annular flange integrally formed with and projecting axially outwardly from said rear end of said body portion of said reflector and concentrically surrounding said circular opening, a ring-like socket member having an annular groove formed therein for receivng said annular flange, a sealing cement located in said groove for bonding said socket member to said flange, a cylindrical socket opening located in said socket member and having a diameter substantially equal to said predetermined diameter of said spherical portion of said plug members so as to allow the latter to be located in said cylindrical support surface and be moved axially and pivoted about said spherical portion for adjustment of the light bulb filament relative to the reflector, a cylindrical chamber to the rear of said socket opening and having a major diameter greater than the diameter of said socket opening, and a sealing cement located in said chamber for bonding said plug means to said socket member after adjustment of said light bulb filament relative to said reflector.

3. A sealed beam headlamp comprising a reflector having a body portion provided with a parabolic surface coated with a reflective material, the rear end of said body portion being formed with a circular opening for receiving light bulb assembly and the front end of said body portion being closed by a light controlling lens, said light bulb assembly including a plug member formed with a spherical portion of a predetermined diameter and having a light bulb supported thereby, an annular flange integrally formed with and projecting axially outwardly from said rear end of said body portion of said reflector and surrounding said circular opening, a ring-like socket member having an annular grooved formed therein for receiving said annular flange, a sealing cement located in said groove for bonding said socket member to said flange, a socket opening located in said socket member having a cylindrical support surface of a diameter substantially equal to said predetermined diameter of said spherical portion of said plug member so as to allow the latter to be located in full peripheral contact with said cylindrical support surface and be moved axially and pivoted about said spherical portion for adjustment of the bulb filament relative to the reflector, said coating of reflective material on said parabolic surface extending radially outwardly from a circle having its center at the center of said socket opening and having its diameter at least equal to the major diameter of said annular flange, and a sealing cement bonding said plug means to said socket member after adjustment of said light bulb filament assembly relative to said reflector.

4. The sealing beam headlamp as set fourth in claim 3 wherein said annular flange is tapered towards a point located to the rear of said reflector.

5. The said beam headlamp as set fourth in claim 4 wherein said annular groove in said socket member is tapered so as to conform to the outer configuration of said annular flange.

* * * * *